US008864592B2

(12) United States Patent
Baxter et al.

(10) Patent No.: US 8,864,592 B2
(45) Date of Patent: Oct. 21, 2014

(54) TURNTABLE RACING SYSTEM

(71) Applicant: Disney Enterprises, Inc., Burbank, CA (US)

(72) Inventors: Anthony W. Baxter, Anaheim, CA (US); Edward A. Nemeth, Hermosa Beach, CA (US); Alfredo M. Ayala, West Covina, CA (US)

(73) Assignee: Disney Enterprises, Inc., Burbank, CA (US)

( * ) Notice: Subject to any disclaimer, the term of this patent is extended or adjusted under 35 U.S.C. 154(b) by 91 days.

(21) Appl. No.: 13/834,481

(22) Filed: Mar. 15, 2013

(65) Prior Publication Data

US 2014/0261052 A1 Sep. 18, 2014

(51) Int. Cl.

| | |
|---|---|
| ***A63G 1/26*** | (2006.01) |
| ***A63G 1/48*** | (2006.01) |
| *A63G 27/04* | (2006.01) |

(52) U.S. Cl.

CPC ..... *A63G 1/48* (2013.01)
USPC ..... 472/31; 472/41

(58) Field of Classification Search

CPC ..... A63B 22/14; A63B 22/18; A63G 1/00; A63G 1/06; A63G 7/00; A63G 31/16
USPC ..... 472/29, 31, 35, 40, 41, 130
See application file for complete search history.

(56) References Cited

U.S. PATENT DOCUMENTS

| | | | | | |
|---|---|---|---|---|---|
| 1,109,421 | A * | 9/1914 | Jobson | ..... | 472/41 |
| 1,499,672 | A * | 7/1924 | Lezert | ..... | 472/28 |
| 1,520,592 | A * | 12/1924 | Mongillo | ..... | 472/31 |
| 2,206,172 | A * | 7/1940 | Estes | ..... | 472/31 |
| 5,395,290 | A * | 3/1995 | Knijpstra | ..... | 472/31 |
| 6,939,236 | B2 * | 9/2005 | McLaren et al. | ..... | 472/90 |
| 8,313,389 | B2 * | 11/2012 | Crawford et al. | ..... | 472/41 |

* cited by examiner

*Primary Examiner* — Kien Nguyen
(74) *Attorney, Agent, or Firm* — Marsh Fischmann & Breyfogle LLP; Kent A. Lembke

(57) ABSTRACT

A ride adapted for providing riders or passengers with a unique ride experience. The ride includes a first turntable assembly including a first turntable and a drive mechanism operable to rotate the first turntable about a rotation axis extending vertically through the first turntable. The ride apparatus includes a second turntable assembly that is supported on the first turntable, and the second turntable assembly includes a second turntable and a drive mechanism operable to rotate the secondary turntable about a rotation axis extending vertically through the second turntable. The ride apparatus includes a number of passenger vehicles mounted on the second turntable that are rotated to maintain an angular orientation to cause the vehicles to face a focal point or area on a projection surface provided about the turntables. The drive mechanisms are operable to independently rotate the first and second turntables about the rotation axes, e.g., no mechanical linkage.

31 Claims, 9 Drawing Sheets

TURNTABLE RACING SYSTEM

BACKGROUND

1. Field of the Description

The present description relates, in general, to theme or amusement park rides with rotating platforms or turntables carrying passenger vehicles that can be rotated in a controlled manner, and, more particularly, to an amusement park ride providing racing and other ride experiences by selectively rotating nested and/or stacked turntables that each carry or support one or more passenger pods or vehicles.

2. Relevant Background

Amusement and theme parks are popular worldwide with hundreds of millions of people visiting the parks each year. Park operators continuously seek new designs for rides that attract and entertain guests in new ways. Many parks include a teacups ride that is an amusement ride characterized by cup-style spinning vehicles atop a turntable-like floor or platform.

A spinning tea-cup ride may be a ride system that includes a number of small turntables (such as three smaller turntables), which rotate about a vertical rotation axis. Each of the small turntables holds a number of teacups (such as six teacups or passenger vehicles), and these small turntables are mounted onto a large turntable and are mechanically connected such that rotation of the large turntable causes rotation of the small turntables as well. Further, movement is achieved by allowing the passengers to manually and independently rotate their individual teacups about a vertical rotation axis while their vehicle moves with the large turntable and also with one of the smaller turntables.

Typically, each set of six teacups has a center bearing mounted underneath, similar to a car wheel bearing mounted on a circular floor capable of turning 360 degrees about a vertical axis extending through the teacup/passenger vehicle. The floor or base of the cup sits on a larger turntable-like platform. This turntable or platform is driven by one or more motors through one or more starting devices, and the ride begins to spin slowly and builds up speed until the maximum design speed is reached. The turntable rotates at the maximum design speed until the turntable slows down and stops at the end of the ride cycle. When in operation, the passengers are able to manually and independently spin each cup while the turntable spins the ride platform/turntable about a center vertical axis. The platform may be driven by a motor fixed or coupled with the platform to rotate the platform or turntable. Each of the stacked or nested turntables is mechanically linked within the system such that their rotation is controlled or affected by movement of the other turntables (i.e., the turntables do not rotate independently from each other).

While tea cup and similar spinning rides remain popular with many, these rides fail to attract or be entertaining for some park visitors because the rapid rotations about one or more axes can be physically upsetting and less enjoyable, e.g., make the rider dizzy. Further, the experience is quite predictable and is common between similar rides. Hence, park operators continue to search for rides that will attract the entire family, and provide novel, new rider experiences.

Further, the tea cup and similar ride is attractive because it requires a relatively small footprint, and it would be desirable to provide a family friendly ride with a level of thrill and competitive excitement that could be provided with a footprint similar to a tea cup-like ride. For example, race rides in which vehicles pass each other throughout the ride are popular in many parks, such as dueling roller coasters, race track-based rides, and the like, but each of these rides undesirably requires a large amount of park real estate, require significant maintenance, and limit ridership to riders above a certain height because of the relatively high dynamics of the ride. Hence, it may be desirable to provide a ride that can provide the race or chase experience with a small or at least smaller footprint and that is relatively inexpensive to maintain and that achieves the racing experience without the need for high dynamics.

SUMMARY

The present description addresses the above problems by providing an amusement park ride (or turntable race system) that selectively orients a plurality of passenger pods or vehicles to direct the passengers' line of sight—typically, toward a common focal point (or "center of attention" for the ride). For example, the passengers may have their vehicles all rotated to have the front of the vehicles "face" a center point where a display may be provided, to instead face one side or the other such as to view imagery or a show element on or near the sidewall of facility housing the ride (e.g., face any point on a screen extending about the set of vehicles), or to face forward such as to view video or other images displayed on a "front" wall of the facility (e.g., during a race operating mode for the ride).

Concurrently with such selective vehicle orienting, the ride system is operable to provide a unique translational movement to each passenger pod or vehicle, which may cause the vehicle to move along a non-linear and non-circular (or irregular circular) path. The translational movement is used to allow the vehicles to be repositioned throughout the ride such that the vehicles may take turns leading, trailing, or being in the pack of vehicles as well as being near either side of the vehicle pack and display or show elements provided on the sidewall(s) of the ride facility.

Briefly, the turntable race system includes two or more nested (or stacked) turntables (or rotatable platforms). Each of the topmost or upper level turntables (or upper sub-turntables is adapted to carry or support one to four or more rider pods (or passenger vehicles). For example, the vehicles are attached to the upper level turntables, and each of the vehicles is supported such that it may be independently rotated (or held in position), by an individual vehicle rotation/drive mechanism, upon the corresponding upper level turntable about a vertical (or canted) rotation axis. Likewise, each turntable is provided with a drive mechanism for rotating the turntables about a vertical (or somewhat canted) rotation axis.

Significantly, the rotation of each rider pod or vehicle and also of each turntable is independently and individually controlled through the rotation or drive mechanisms (e.g., electrical motors or the like) that are attached to a rotating element of each vehicle and turntable. There is no mechanical linkage between turntables with regard to rotation about the rotation axis or between the turntables and the rider pods/vehicles. In other words, the lower level turntables physically support upper level turntables (as the uppermost level turntables support the passenger vehicles), but each of the supported elements (turntables or vehicles) is free to rotate about its rotation axis independently from the supporting turntable.

Rotation of the drive or rotation mechanisms (e.g., motors) of each turntable and vehicle/pod on a turntable is tightly controlled in the turntable race system described herein. For example, a common computer system (or ride controller) may be provided that executes or runs software that is adapted to generate and communicate control signals to the drive mechanisms to synchronize rotation of the turntables and rider vehicles. This may involve aligning the front of each vehicle such that each passenger is oriented to face a focal point (center of attention) defined for the ride at a particular point in time for the ride (e.g., the center of attention may be varied along the course of the ride such as toward the "front", the left side, the right side, the "back", or the center of the base turntable).

To this end, the position of each turntable is monitored on an ongoing basis (e.g., the location of the center or rotation axis as well as amount of rotation about its rotation axis). This allows the ride controller to determine or calculate the orientation of each rider pod or passenger vehicle in world coordinates such as through various coordinate transformations. Then, as the turntables are rotated during a ride program, the ride controller may generate control signals that are provided to the drive mechanisms to rotate the turntables and/or passenger vehicle to have the passenger vehicles all face a like direction (toward a center of attention or focal point) or toward specific locations within the show space. In some embodiments, each of the rotating elements (turntables and passenger vehicles) is capable of rotating at multiple speeds and in either a clockwise or counterclockwise direction about their respective rotation axis.

Direct control and tight synchronization of the individual elements (e.g., control over rotation of each rider pod and/or each turntable without reliance on mechanical linkages or allowing rider control such as spinning) allows the turntable race system to be readily configured for theatrical settings and for providing unique visual ride experiences. In one embodiment, the turntable race system includes a 360 degree theater in which the individual rider pods or passenger vehicles are caused to follow complex paths (e.g., provided translation movement) through the show/ride space and, concurrently, are rotated in a synchronized manner such that each passenger typically faces in the direction of travel represented by the media.

For example, video may be displayed on the turntables and also on the sidewalls (and, optionally, the ceiling) of the theater or show space facility to provide the illusion of movement in a particular direction toward a focal point (e.g., a "front" wall surface may display video or imagery of an "approaching" scene). Particularly, the inventors have performed animations and demonstrations in the DISH virtual environment (i.e., Digital Immersive Showroom used for designing attractions and the like at the Walt Disney Imagineering campus in Glendale, Calif. and an implementation of Cave Automatic Virtual Environment (CAVE) technology) so as to prove the overall concept and useful implementations. These demonstrations, using a wide variety of show content, have shown that the illusion is both convincing and engaging to riders/passengers of pods/vehicles.

More particularly, a ride apparatus is provided for providing riders or passengers with a unique ride experience. The ride apparatus includes a first turntable assembly including a first turntable and a drive mechanism operable to rotate the first turntable about a rotation axis extending vertically through the first turntable. The ride apparatus also includes a second turntable assembly that is supported on the first turntable, and the second turntable assembly includes a second turntable and a drive mechanism operable to rotate the secondary turntable about a rotation axis extending vertically through the second turntable. The ride apparatus further includes a number of passenger vehicles mounted on the second turntable. The drive mechanism of the first turntable assembly and the drive mechanism of the second turntable assembly may be operable to independently rotate the first and second turntables about the rotation axes (e.g., no mechanical linkage tying rotation of one turntable to the other).

During operations of the ride apparatus, the first turntable may be rotated at a first rotation rate while the second turntable is rotated at a second rotation rate greater than the first rotation rate. Also, during ride apparatus operations, the first turntable may be rotated in a first rotation direction about the rotation axis of the first turntable and the second turntable may be rotated in a second direction about the rotation axis of the second turntable, with the first and second rotation directions being the same or differing during operation of the ride apparatus (e.g., differing ride paths for the passenger vehicles are defined by differing the rotation rates and/or rotation directions of the individually rotatable and nested/stacked turntables).

Two or more levels of turntables may be used to practice the ride apparatus. For example, some apparatus embodiments include a third turntable assembly including a third turntable, supported on the first turntable and supporting the second turntable, and a drive mechanism operable to rotate the third turntable about a rotation axis extending vertically through the third turntable. In such embodiments (with three nested/stacked levels of independently rotating turntables), the drive mechanism of the third turntable assembly may be independently operable relative to the drive mechanisms of the first and second turntable assemblies to rotate the third turntable at a rotation rate and in a rotation direction, with the rotation rate of the third turntable typically being greater than a rotation rate of the first turntable and the rotation direction of the third turntable being clockwise or counterclockwise (i.e., the same or different from the other turntables).

In some preferred embodiments, a rotation mechanism is included for each of the passenger vehicles that is operable during operation of the ride apparatus to rotate the passenger vehicles independently of the rotation of the second turntable. In such embodiments, the rotation mechanisms are each operated, concurrently with the rotation of the first and second turntables, to maintain an angular position of the passenger vehicle relative to a predefined point. Further, the ride apparatus may include mechanisms for monitoring angular positions of the first and second turntables and the passenger vehicles, for determining a present angular position of each of the passenger vehicles, and for operating the rotation mechanisms based on a comparison of the determined present angular positions with the angular position relative to the predefined focal point.

In many embodiments, the ride apparatus includes a display surface extending along at least a portion of the periphery of the first turntable. For example, the nested turntables may be housed within a 360-degree theater or the like. In such embodiments, media content (still or, more typically, video images) is provided on the display surface, and the provided media content is synchronized with the rotation of the first and second turntables and a line of sight of passengers in the passenger vehicles. For example, the displayed content may be designed to provide the passengers with a sensation of lateral movement through a space even though the turntables only rotate about fixed-in-place rotation axes.

DETAILED DESCRIPTION

Figure 1:
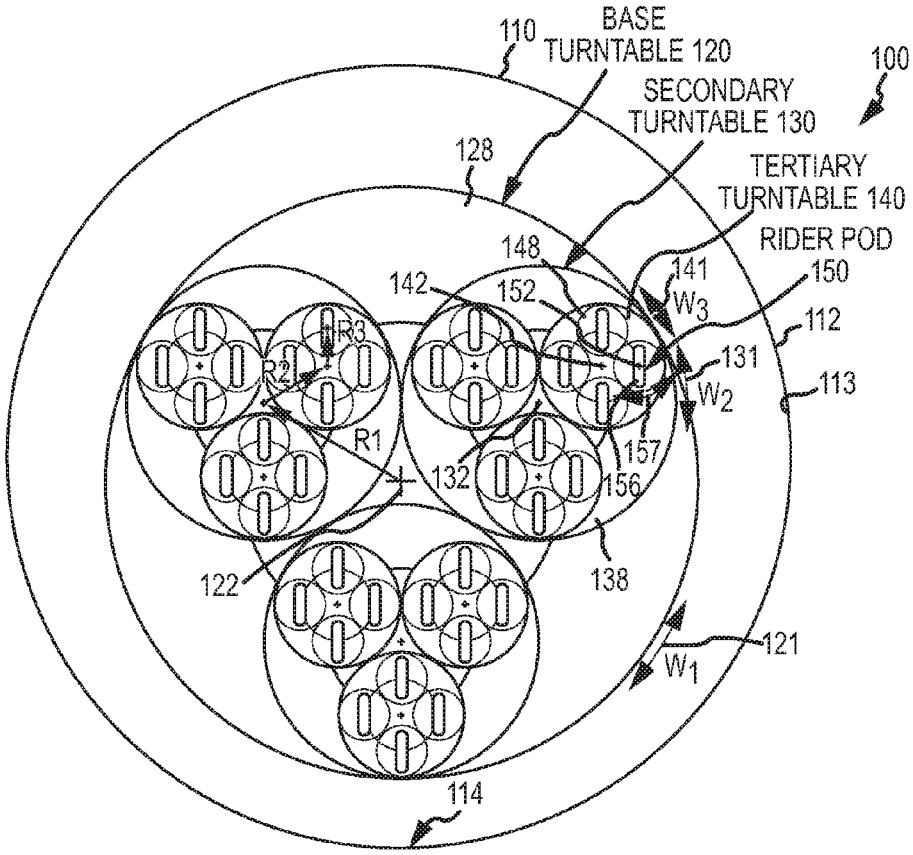
FIG. 1 is a top or plan view of an amusement park ride or turntable race system with nested/stacked turntables and passenger vehicles on the upper or top turntables or sub-turntables (e.g., the system includes a primary (large) turntable, three secondary (smaller) turntables (or sub-turntables) on the primary turntable, and, on each of the secondary turntables, three tertiary (smallest) or upper turntables (or sub-turntables) with rotatable vehicles provided on the upper turntables)

Briefly, the following description is directed to an amusement park ride (herein "a turntable race system") that can be provided with a relatively small footprint similar to a round ride but be designed and operated to provide a level of thrill, e.g., a racing or chasing experience, for the entire family. A theater or show facility may be provided in the turntable race system to provide a 360-degree theater or projection screen or show elements such as animatronics or the like may be positioned about the periphery or overhead of the ride components. Typically, these show elements or the projection sidewalls may be cylindrical or dome shaped to enclose the ride components.

The ride components generally include a set of nested or stacked turntables such as 2 to 3 or more levels of turntables, with each upper turntable level having smaller turntables that move with the larger turntables on the lower or supporting turntable levels. The turntables, however, are not otherwise interconnected or linked together such that individual drive or rotation mechanisms (electric drive motors) may be used to rotate each of the turntables at different rotation rates or speeds and/or in the same or differing directions (clockwise or counterclockwise) about their rotation axis (vertical or canted axis). Further, each top level or uppermost turntable may include rider pods or passenger vehicles, and each of these pods or vehicles is supported such that a drive or rotation mechanism may be independently operated to rotate each pod or vehicle.

The turntable race system further includes a ride controller that can determine the orientation of each pod/vehicle throughout the operation of the system to provide a particular ride experience (as may be defined by a ride program stored in system memory). In this manner, each of the pods/vehicles may be aligned or arranged to face (have the front end of the vehicle/pod pointed at) a common focal point (or two or more differing focal points in some portions of a ride program).

For example, monitoring of rotation of each of the turntables may be used to determine how much (if any) and which direction of rotation of the pod/vehicle should be performed to cause the vehicle/pod and its passengers/riders to face toward a predefined focal point for that point along the ride path or in the ride program. This may involve causing all the vehicles/pods to face toward a particular point on the sidewall/screen of the 360 degree theater/ride enclosure (e.g., the "front" portion of the sidewall) even as their vehicle is moved along a vehicle or ride path by concurrent rotation of the nested or stacked turntables. The focal point may change during the ride program such as to have the vehicles first face toward the center of the theater/enclosure and then face the front of the theater/enclosure to start a race or chase adventure in which each pod/vehicle takes turns being in the lead of the pack, in the back of the pack, and in the middle on either sides or in the central portion of the pack.

Since the movement of the turntables and the direction individual riders face are defined by a software program, rather than a mechanical linkage, multiple ride programs can be designed and stored such that a rider experiences a different show each time they ride.

FIG. 1 illustrates an exemplary embodiment of a turntable race system 100 that may be used to provide unique ride experiences. As shown, the system 100 includes a ride platform or facility base structure 110, which is stationary or does not move during operation of the ride system 100 as it acts to physically support other ride components. The ride platform 110 is shown to be circular in shape, but this is not a limiting requirement of the system 100. The ride platform 110 also provides a ride mount and dismount surface for the rider pods or passenger vehicles 150, and passengers (not shown in FIG. 1) may walk over the ride platform 110 to reach the vehicles 150.

About the exterior or periphery of the ride platform 110, a projection screen or show element(s) 113 is provided on a sidewall/ceiling 112, and, in a 360-degree theater implementation of ride system 100, the projection screen 113 may include a continuous or number of projection surfaces. A projection system (not shown in FIG. 1) may be operated (e.g., by a media controller also not shown in FIG. 1) to project images on the projection screen 113. A focal point or center of attention may be selected on the projection screen 113 such as at the "front" portion 114 of the facility sidewall 112. For example, the ride system 100 may be operated to provide a race experience, and images of objects that are approaching "moving" vehicles 150 and visible in front of the vehicles 150 may be displayed near or on the front portion 114 while images of objects passing the sides of the vehicles 150 are displayed on the side portions of screen 113 (and, optionally, objects passing below the vehicles 150 may be projected on the turntables 120, 130, 140 and objects passing above the vehicles 150 may be projected on the ceiling of structure 112). In this manner, a sensation of movement toward the front portion 114 is provided to the passengers in or on the vehicles 150.

The turntable race system 100 includes nested or stacked turntables to move the passenger vehicles 150 along a ride path while video/imagery or other show elements/displays are provided on or near the screen(s) 113. Particularly, the system 100 includes a base or primary turntable 120 that is rotated (by a drive mechanism that may be below the turntable 120 in or under the platform 110) about a central rotation axis 122. As shown with arrow 121, the rotation of turntable 120 may be in either direction (clockwise or counterclockwise) and may be at a rotation rate or speed, $w_1$, that may be held constant or varied and is defined by a ride program run by a ride controller (not shown in FIG. 1).

On the upper surface (or nested within the upper surface to provide flush ride surface) 128, a number (e.g., 1 to 3 or more)

of secondary turntables (or sub-turntables) 130 are provided and supported so as to rotate 121 with the primary or base turntable 120. Three secondary turntables 130 are shown but additional turntables may be provided (such as smaller ones to fill empty space on upper surface 128) to practice the system 100. The secondary turntable 130 is provided in the ride system 100 such that it can be rotated about a central rotation axis (vertical or canted axis) 132. As shown, with arrow 131 the rotation may be in either direction about axis 132 and may also be at one or more rotation rates or speeds, $w_2$. Each of the secondary turntables 130 may be rotated 131 independently from the primary turntable 120 by its own drive mechanism such that the direction of rotation 131 and the rate, $w_2$, are independent of and not mechanically linked to the rotation 121 of the primary turntable 120. For example, the rotation rate, $w_2$, may be greater than the rotation rate, $w_1$, in some ride programs, and it may be varied during the ride program while the rotation rate, $w_1$, is held constant (or separately varied, if desired).

On or in an upper surface 138 of each of the secondary turntables 130, a number (1 to 3 or more) of tertiary turntables 140 are stacked or nested, and the turntables 140 move with the primary turntable 120 (as it rotates 121) and also with the secondary turntable 130 upon which they are mounted (e.g., with rotation 131). Further, each of the tertiary turntables 140 is provided with an independent drive mechanism that may be operated (via a ride controller generating control signals based on a ride program) to rotate 141 the tertiary turntable 140 about a central rotation axis (vertical or canted). The rotation rate or speed, $w_3$, may differ from the rotation rates, $w_1$ and $w_2$, of the turntables 120 and 130 and may be varied independently during a ride program (operation of the ride system 100) as may be the rotation 141 direction about the axis 142.

On the uppermost turntable (in system 100 this is the tertiary turntable 140 but additional turntables may be stacked to provide more turntable levels) 140, a number (1 to 4 or more) of passenger vehicles or rider pods 150 are mounted on an upper surface 148. Each of the vehicles has a body with a front end or portion 156, and a drive mechanism is provided to rotate or align 151 each vehicle with rotation about a vehicle rotation axis 152 (again a vertical or canted axis). The vehicle 150 is moved along a ride path by the rotations 121, 131, 141 of the nested or stacked turntables 120, 130, 140, and the shape of the ride paths is defined by the direction and rates, $w_1$, $w_2$, and $w_3$, of the rotations 121, 131, 141 (as discussed further with references to FIGS. 3A to 3D).

The rotation 151 may be controlled by a ride controller so as to cause the front end 156 to face or be proximate to a focal point or center of attention in the facility 112 defined by a particular ride program for a particular point in time of the ride program (such as toward the front portion 114 of the screen 113 or the like). Again, the rotation 151 is independent from the rotations 121, 131, 141 as the vehicle 150 is supported on one of the uppermost turntables 140 but its rotation 151 is controlled by a ride controller operating a drive mechanism (and not by mechanical linkage to any of the turntables 120, 130, 140). The vehicle supports and/or drive mechanisms may also provide pitch, roll, and/or yaw of the vehicle 150 based on rider input and/or based on controls defined by the ride program executing during operation of the ride system 100.

The primary or base turntable 120 is larger in diameter than the secondary turntables 130 such as with a first diameter (e.g., 30 to 100 feet) that is 1.5 to 3 times as large as the diameter (second diameter, e.g., 20 to 70 feet) of the secondary turntables 130. Likewise, the secondary turntables 130 have diameters that are larger than the diameters (a third diameter, e.g., 5 to 40 feet) of the tertiary turntables 140. The vehicle rotation axes 152, the tertiary rotation axes 142, the secondary rotation axes 132, and the primary rotation axis 122 are typically parallel to each other. Further, the upper surfaces 128, 138, 148 of the turntables 120, 130, 140 are preferably coplanar or nearly so to facilitate loading and unloading of the passenger vehicles 150. Each of the turntables 120, 130, 140 may take the form of a planar disk or similar body shape.

Figure 2:
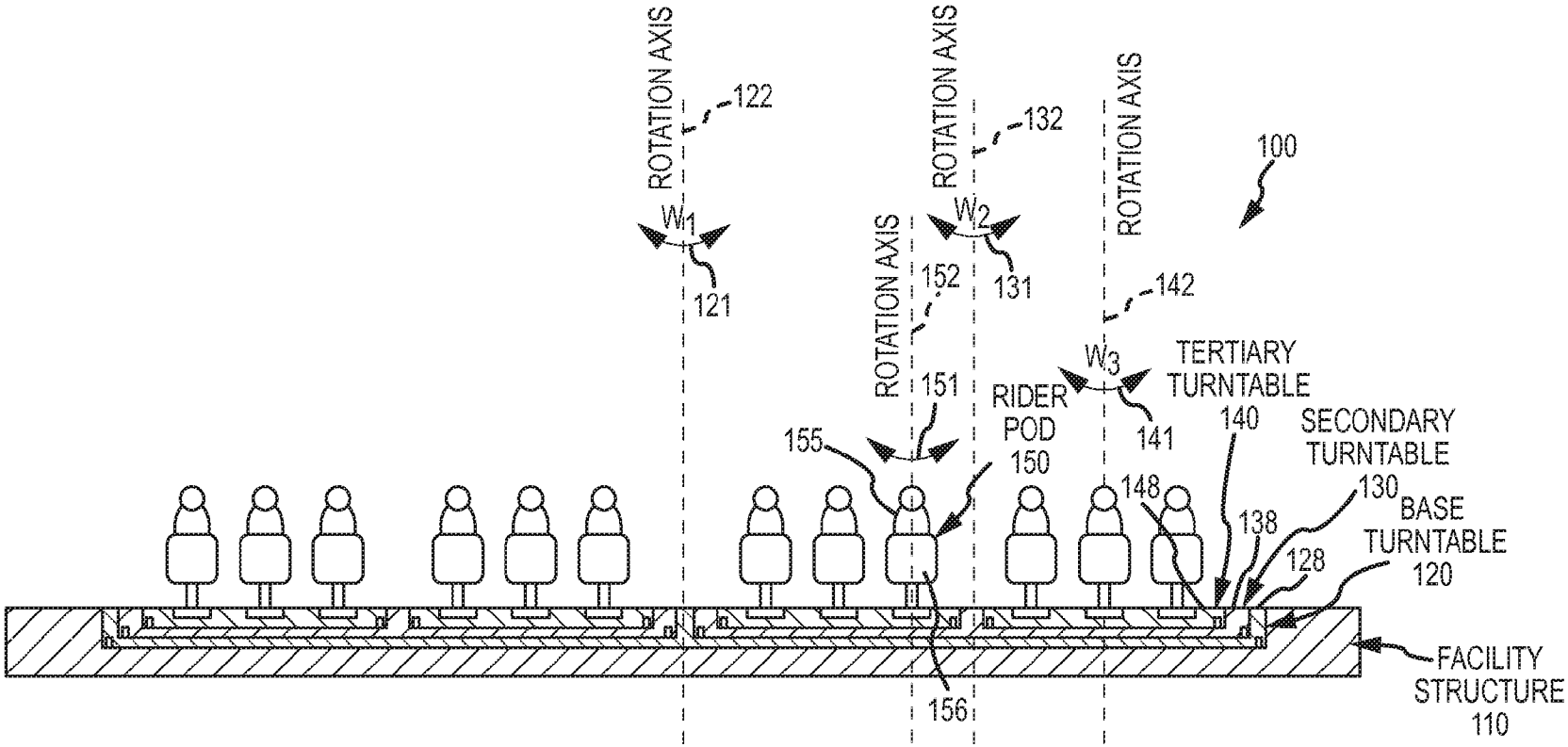
FIG. 2 illustrates a partial sectional view of the turntable race system of FIG. 1 showing the nested or stacked arrangement of the turntables and the parallel nature of the rotation axes of the turntables as well as the rider pods (or passenger vehicles)

One nesting/stacking arrangement of the system 100 is shown with the side sectional view of FIG. 2 such as may be seen from the vantage point of the front 114 of the screen 113 looking into the structure 112. As shown, the base or primary turntable 120 is supported within a recessed surface or portion of the facility structure or platform 110, which is a stationary element, and a drive mechanism (not shown) is operable to rotate 121 the base turntable 120 about the center rotation axis 122. The rotation 121 causes the supported secondary and tertiary turntables 130, 140 and the vehicles 150 supported on the tertiary or uppermost turntables 140 to also rotate 121 about the axis 122.

Further, as shown, the secondary turntables 130 are supported within recessed surfaces of the upper surface 128 of the primary turntable 120. The secondary turntables 130 are supported such that independently operable drive mechanisms (not shown) provided for each secondary turntable 130 may be operated to rotate 131 each of the secondary turntables 130 about their corresponding secondary rotation axis 132. Also, the tertiary turntables 140 are supported within recessed surfaces of the upper surface 138 of the secondary turntables 130. The tertiary turntables 140 are supported such that each may be rotated 141 about their respective tertiary rotation axis 142 in an independent manner by a dedicated drive or rotation mechanism (not shown).

Still further, each rider pod or passenger vehicle 150 is positioned on the upper surface 148 of one of the tertiary turntables 140, and a drive mechanism provided for each vehicle 150 may be operated to align or orient the vehicle 150, e.g., with the front end 156 facing or proximate to a focal point of the facility sidewall 112 such as the front portion 114 (shown in FIG. 1). In this position of the vehicle 150, a passenger or rider 155 is facing a center of attention defined for a particular point of the ride program executed by the ride controller of the ride system 100.

As will be appreciated, the independent rotation of the turntables 120, 130, 140 allows a ride program to be designed to cause a passenger vehicle to provide any of a very large number of ride paths. Significantly, the ride path may be changed for differing ride programs as mechanical linkages are not used, which would limit the relative turntable movement and define a single, repetitive ride path. Particularly, FIGS. 3A to 3D show with graphs or schematics 310, 320, 330, and 340 four differing ride paths that may be provided by execution of one or two or more differing ride programs.

Figure 3B:
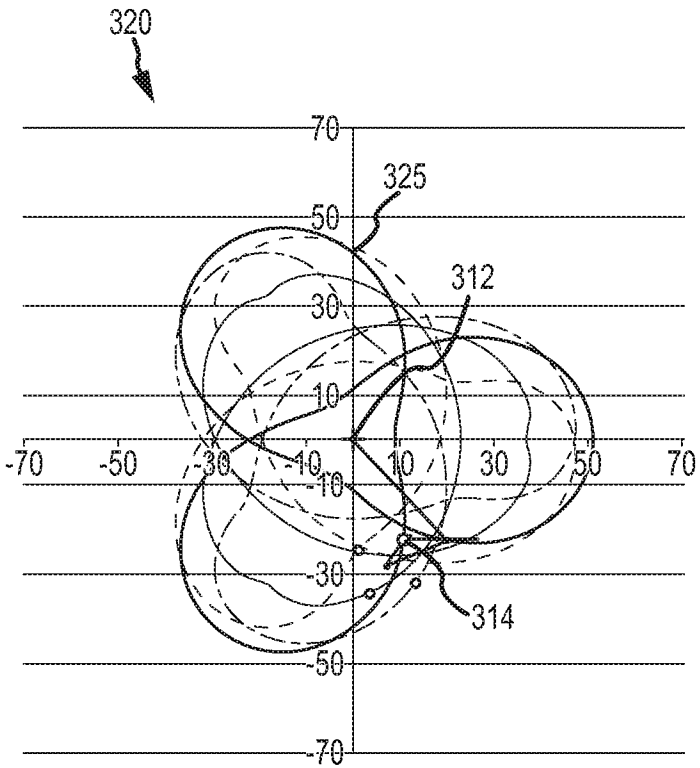
FIGS. 3A-3D illustrate graphically four exemplary ride paths that may be provided for passenger vehicles or rider pods by setting differing rotation rates for the three nested/stacked turntables (which would not be possible if the turntables were mechanically linked together as such linkage would define a single, fixed ride path)
Figure 3A:
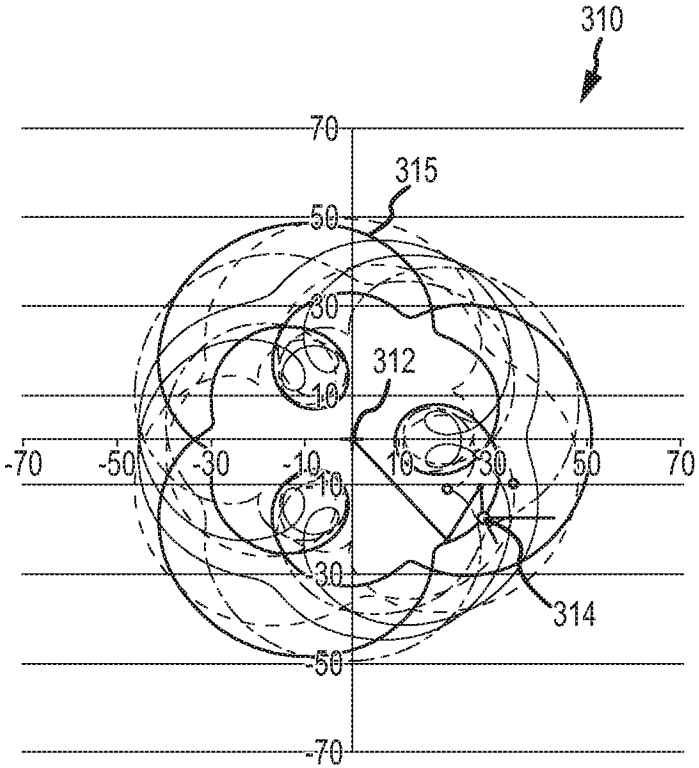

In the graph 310 of FIG. 3A, line 315 illustrates a ride path that would be followed by a passenger vehicle 314 due to the combined rotations of three nested turntables. For example, the turntables 120, 130, 140 may be rotated at rates $w_1$, $w_2$, and $w_3$ to cause a vehicle 150 to follow path 315. This irregular path 315 was achieved with the radii R1, R2, and R3 shown in FIG. 1 having values of 30.03 feet, 13.94 feet, and 7.07 feet, respectively, and turntable rotation rates, $w_1$, $w_2$, and $w_3$, of 6 degrees/second, 9 degrees/second, and 18 degrees/second, respectively. As can be seen with path 315, the vehicle 314 moves from the front of the pack of vehicles to the center of the pack over an irregular path and then to the back of the pack prior to moving back to the center of the pack and one of the sides of the show space. The primary turntable 120 is rotated about the center axis 312 and the turntables 130 and 140 are rotated independently upon their supporting or next-lower level turntable.

In this example, each of the secondary and tertiary turntables 130 and 140 are rotated at matching rotation rates and in the positive or clockwise direction such that each vehicle 150 carves out a similar ride path 315. During operation of a ride, the vehicle 314 may also be rotated so as to have its front end aligned with a particular center of attention or focal point (such as to always "face" front) throughout the ride path 315 (or the focal point may be changed at any point along the ride path 315).

This same ride (e.g., with the same turntables 120, 130, 140 and ride vehicles 150) may be operated according to another ride program to achieve the results illustrated with the graph 320 of FIG. 3B. When this ride program is executed by the ride controller, the vehicle 314 follows the path 325, which can be quickly seen to differ significantly from the path 315 of FIG. 3A. This is achieved by rotating the primary turntable 120 at a rate, $w_1$, of 6 degrees/second (in a first direction or clockwise about the center rotation axis 122), the secondary turntables 130 each at a second greater rate, $w_2$, of −9 degrees/second (i.e., in a second direction or counterclockwise about the rotation axes 132), and the tertiary turntables 140 each at a third even greater rater, $w_3$, of 18 degrees/second (i.e., in the first direction or clockwise about the rotations axes 142). Note, in addition to a differing ride path, the ride experience provided by the two programs also differs in the resulting accelerations experienced by the riders/passengers (e.g., with those of the second program being relatively minor (or in a tight band) while those of the first program are relatively larger (or in a band that may be 2 to 4 times as large)).

Figure 3D:
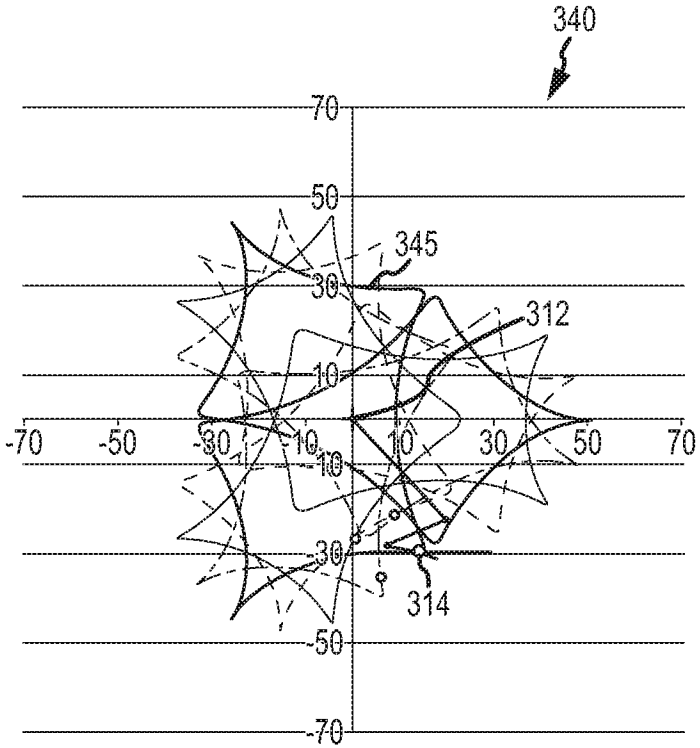
Figure 3C:
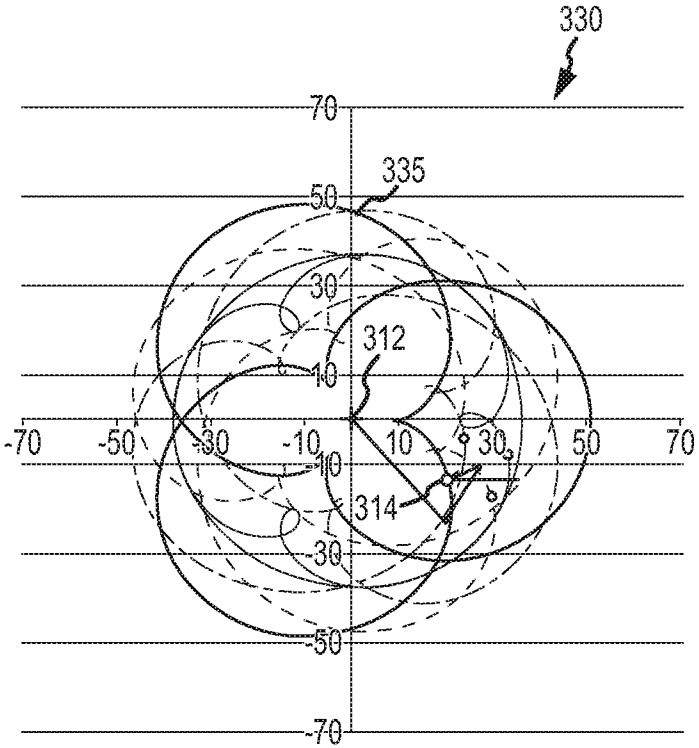

FIG. 3C illustrates the same ride system 100 operated according to a third ride program to cause a vehicle 314 to follow a third ride path 335, which differs from both path 315 and path 325. This is achieved by rotating the primary turntable 120 at a rate, w1, of 6 degrees/second (in a first direction or clockwise about the central rotation axis 122), rotating each of the secondary turntables 130 at a second greater rate, $w_2$, of 9 degrees/second (also in the first direction or clockwise about the secondary rotation axes 132), and rotating each of the tertiary turntables 140 at a third and even greater rate, $w_3$, of −18 degrees/second (i.e., in a second direction or counterclockwise about the tertiary rotation axes 142). The acceleration experience with the third ride program may be in a range falling between that of the first and second ride programs.

FIG. 3D illustrates yet another ride path 345 that may be followed by the vehicle 150 when the system 100 is operated according to a fourth ride program. The fourth ride path 345 is quite different in shape and the rider experience than the first, second, and third ride programs. The path 345 is achieved by rotating the primary turntable 120 at a first rotation rate, $w_1$, of 6 degrees/second (in a first direction or clockwise about the center rotation axis 122), rotating each of the secondary turntables 130 at a second greater rotation rate, $w_2$, of −9 degrees/second (in a second direction or counterclockwise about the secondary rotation axes 132), and rotating each of the tertiary turntables 140 at a third and even greater rotation rate, $w_3$, of −18 degrees/second (in the second direction or counterclockwise about the tertiary rotation axes 142). The acceleration range applied to the passengers of the vehicle 150 with the fourth ride program may be similar to that of the third ride program but with the experience being very different (e.g., acceleration occurring at differing times and the vehicle 150 being positioned differently relative to other vehicles 150 and the displayed images or show elements on or near the screen 113).

Figure 4A:
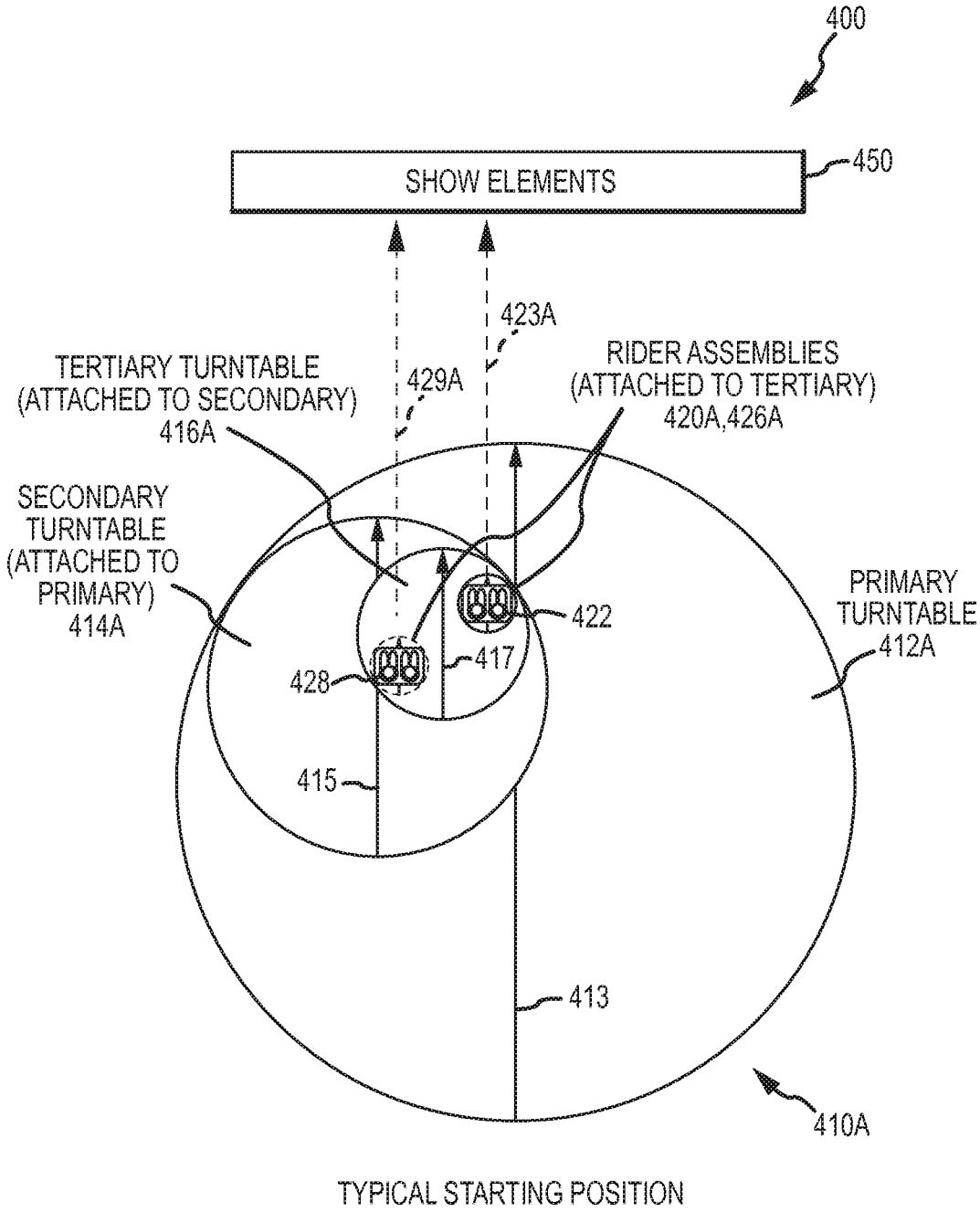
FIGS. 4A-4D illustrate schematically a turntable race system during operation (executing a ride program) showing effect of rotation of nested turntables on a stationary (or uncorrected orientation) vehicle assembly and use of drive mechanism associated with a rotatable (or corrected orientation) vehicle assembly.

FIGS. 4A-4D illustrate schematically a turntable race system 400 during operation (executing a ride program) showing effect of rotation of nested turntables 410A on a stationary (or uncorrected orientation) vehicle assembly and use of drive mechanism associated with a rotatable (or corrected orientation) vehicle assembly. Particularly, FIG. 4A shows a typical starting position for the ride system 400 in which two vehicle assemblies 420A and 426A are in a starting or load/unload position. The vehicle assemblies 420A and 426A are mounted for rotation upon a tertiary turntable 416A (also shown in a load/unload or starting/first position).

In this starting position, the front of the vehicle assemblies 420A and 426A is facing or proximate to a focal point or to show elements 450 such that the line of sight 423A and 429A of the passengers 422, 428 is toward the show elements (or another focal point defined for a ride program in a particular show space). As discussed with reference to FIGS. 1 and 2, the ride system 400 further includes a secondary turntable 414A in a starting position, and the secondary turntable supports the tertiary turntable 416A such that a drive mechanism may rotate the turntable 416A The secondary turntable 414A is mounted on a primary turntable 412A shown in a first or starting position, and the secondary turntable 414A may rotate about it rotation axis while the primary turntable 412A may also rotate about the central or primary rotation axis.

For ease of explaining relative movement and vehicle orientations, the vehicle 420 will be rotated about its rotation axis to maintain a desired line of sight to show elements 450 (as is typical for a ride program and/or for control of a ride system 400 by a ride controller) while vehicle 426 will be stationary on turntable 416 such that the light of sight 429A is not maintained (e.g., orientation of the rider assembly 420 is corrected over time while the orientation of the rider assembly 426 is not corrected). Central chords 413, 415, 417 of the turntables 412, 414, 416 are shown to better illustrate the rotation of the turntables 412, 414, 416 about their individual rotation axes.

Figure 4B:
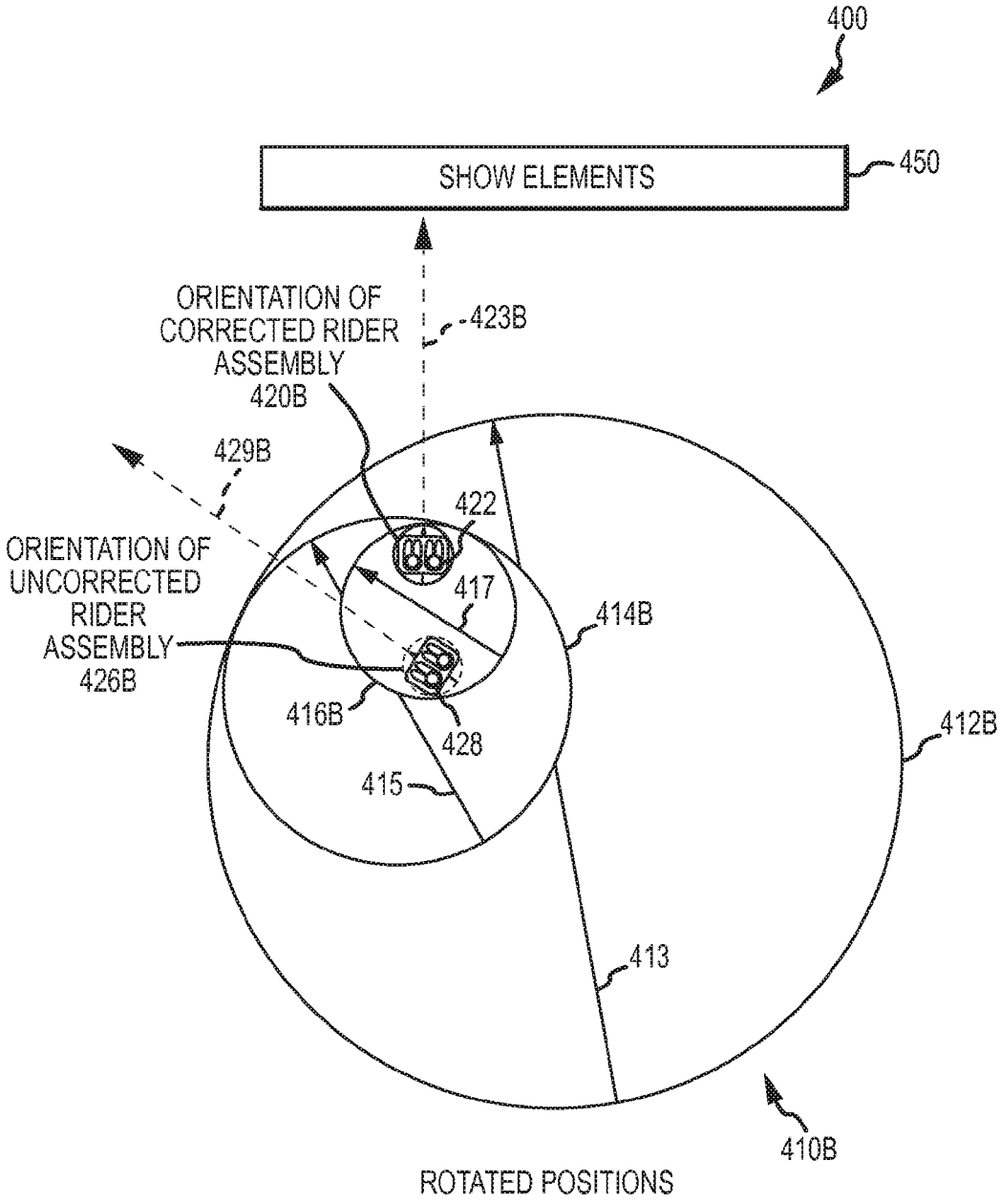

FIG. 4B shows the ride system at a second time after the ride program has been executed for a period of time so as to alter the relative angular position (amount of angular rotation) of the three levels of turntables. Particularly, it can be seen that the primary turntable 412B has rotated counterclockwise about 10 degrees. Concurrently and separately, the secondary turntable 414B has rotated about 30 degrees in this same direction, i.e., counterclockwise about its rotation axis. In other words, the turntables 412B and 414B have been rotating according to the ride program at differing rotation rates (or angular rotation rates as discussed above with regard to FIGS. 3A to 3D). Also, it can be seen in FIG. 4B that the tertiary turntable 416B has been rotated about 60 degrees in the same directed (i.e., counter clockwise).

If a vehicle 426B is not concurrently rotated, the line of sight 429B will not be toward the show elements 450 as typically will be desired for a ride system 400. Hence, the ride system 400 may be configured and controlled to operate a drive mechanism associated with vehicle assembly 420B to rotate the vehicle assembly 420B to correct the orientation of the vehicle 420B (e.g., to keep the front portion or edge facing forward (facing in same direction as at starting position or angled inward toward a particular focal point) to provide line of sight 423B to the show elements 450.

Figure 4C:
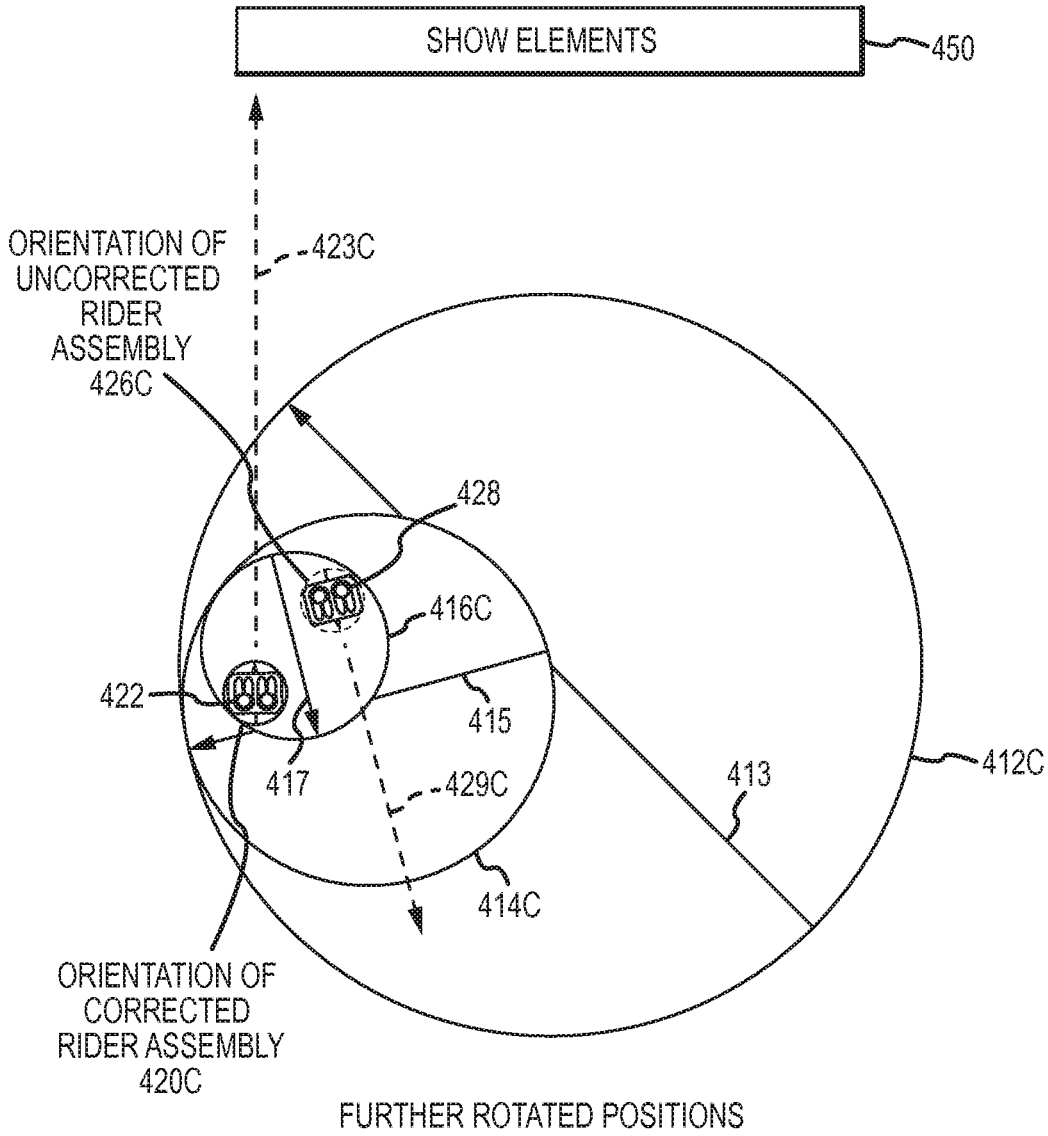

FIG. 4C shows the ride system 400 at a third point in time after the ride program has been executed by the ride controller of system 400 for an additional length of time. As shown, the primary or base turntable 412C has been rotated about 45 degrees counterclockwise while the secondary turntable 414C has been rotated about 105 degrees in this same direction and the tertiary turntable 416C has been rotated about 190 degrees in this same or clockwise direction.

The drive mechanism of the vehicle assembly 420C has been concurrently operating to correct orientation of the passenger 422 to keep the line of sight 423C toward the show elements 450, but the vehicle assembly 426C has been uncorrected (not rotated separately from the tertiary turntable 415C). Hence, the passengers 428 are facing away from the show elements 450, which may be undesirable whereas the passengers 422 continue to be aligned to continue to view the show elements 450 throughout rotation. By selecting the show elements 450 (and images presented on screens 113 in system 100), the riders 422, 428 may be caused to believe or sense they are moving along the line of sight 423 toward the show elements 450 rather than noticing rotations and/or actual backward movements (as the base or primary turntable 412 is not moved to provide any linear translational movement (i.e., the center or primary rotation axis is stationary)).

Figure 4D:
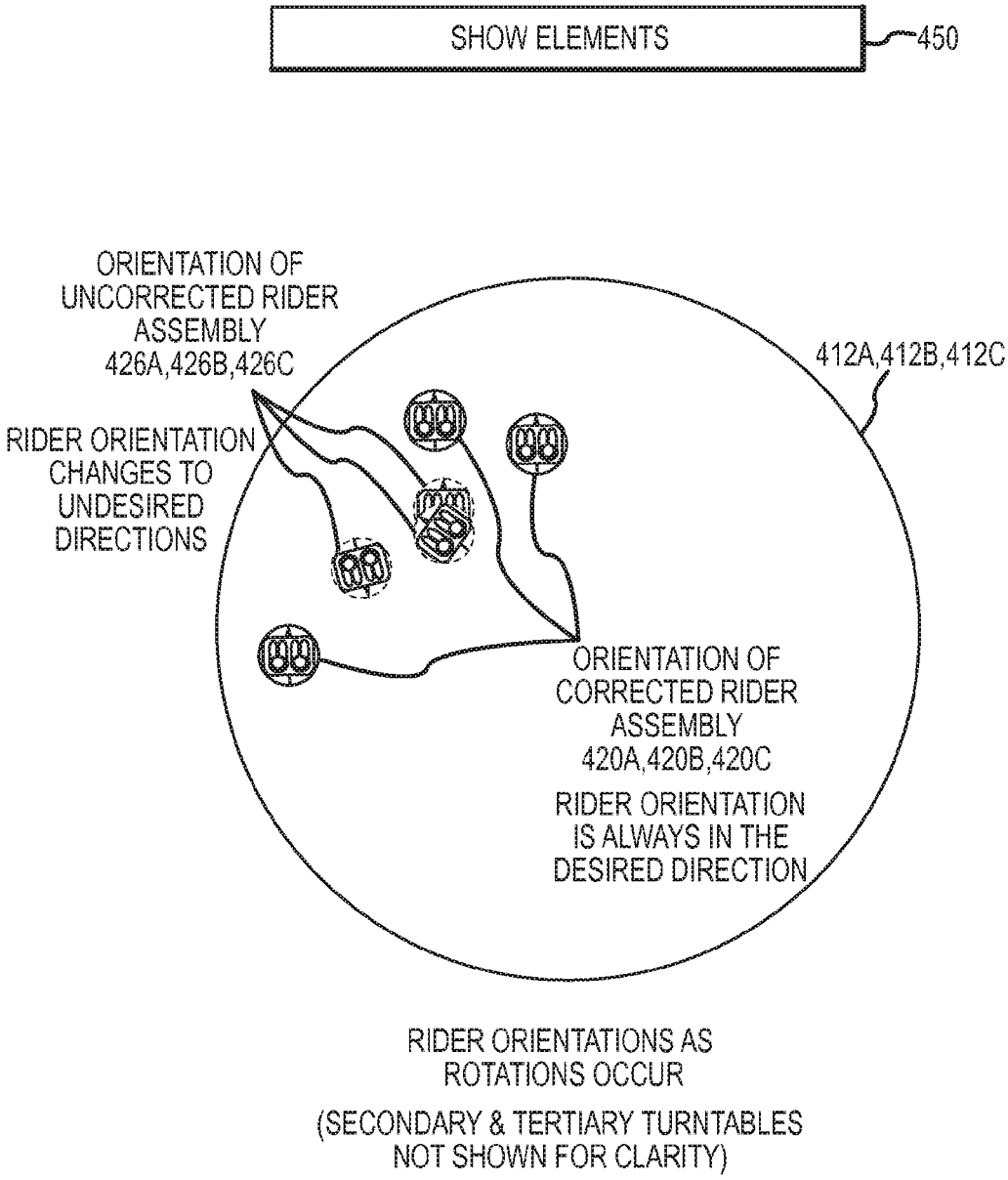

FIG. 4D illustrates (with the secondary and tertiary turntables 414, 416 removed/hidden) movement of the vehicle assemblies 420 and 426 along their ride paths. As can be seen at 426A, 426B, 426C, the vehicle assembly 426 is not rotated individually to correct orientation such that its riders have their orientation changed to undesired directions. In contrast as shown at 420A, 420B, 420C, the vehicle assembly 420 is rotated concurrently and separately from the turntables 412, 414, 416 so that the rider orientation is always in the desired direction, i.e., in this example of a ride program, with the front of the vehicle assembly 420 facing forward or toward the show elements 450.

Figure 5:
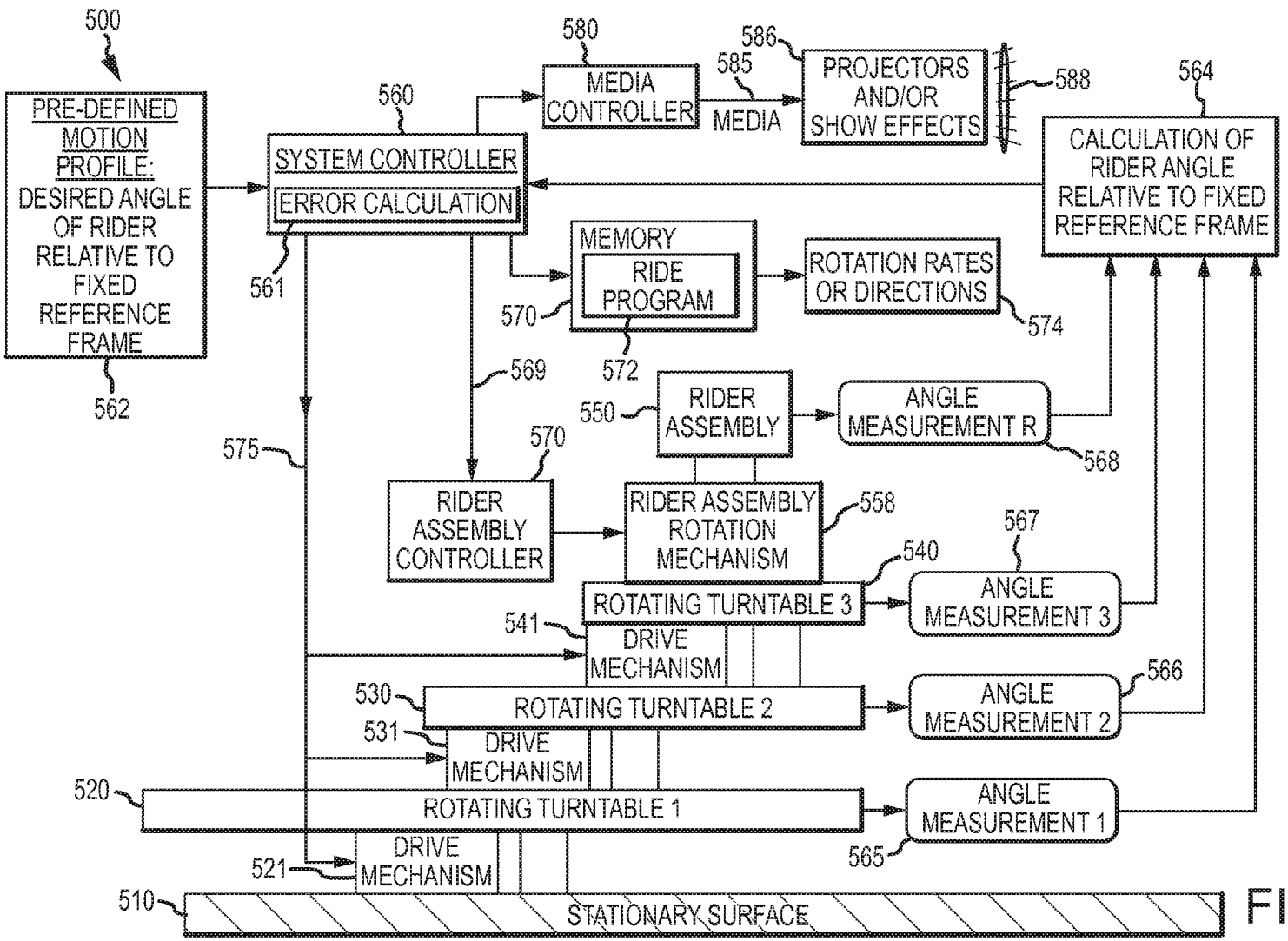
FIG. 5 is a functional block diagram of an amusement park ride including a control assembly for providing synchronization of the rotation of the nested turntables, the rider assemblies, and the displayed media or show elements to provide a unique ride experience.

FIG. 5 is a functional block diagram of an amusement park ride 500 including a control assembly for providing synchronization of the rotation of the nested turntables, the rider assemblies, and the displayed media or show elements to provide a unique ride experience. The control assembly may take a number of forms to practice the invention such as a computer or electronic device with a processor executing program or code configured to cause the computer to perform a number of functions as discussed below. For example, the system or ride controller 560 may be a computer with a processor executing code such as code for performing calculations of rider pod angles as shown at 564 or performing error calculations as shown at 561 and then issuing control signals 569 to a rider assembly controller 570. Typically, the executable code or programs will be provided in non-transitory computer readable medium.

The system 500 is shown to include a stationary surface or platform 510. A primary or base level turntable 520 is pivotally supported on the platform 510 to rotate about its center or the primary rotation axis when driven/rotated by a drive mechanism (e.g., a motor responsive to control signals 575 from ride controller 560). A number (e.g., 1 to 3 or more such as 5 to 7) of secondary or midlevel turntables 530 are pivotally supported on the primary turntable 520, and rotate when driven/rotated by drive mechanisms 531. Further, a number (such as 1 to 3 or more) of tertiary or upper level turntables 540 are pivotally supported upon the secondary turntables 530 so as to rotate when driven by drive mechanisms 541.

Additionally, on each tertiary turntable 540, a number (e.g., 1 to 7 or more) of rider assemblies 550 are mounted and selectively rotated by a rider assembly rotation mechanism 558 (also supported on the tertiary turntable 540 in most implementations). A rider assembly controller 570 is provided for each (or for all or groups of) rider assembly rotation mechanism 558 to operate/control the rotation mechanism to selectively rotate the rider assembly 550 to align the front edge (or another portion of the assembly) with a target or focal point (e.g., to cause the passengers/riders of assembly 550 to face or have their line of sight on a particular portion of a projection screen or show element).

Control signals 575, 569 are generated by a system or ride controller 560 for the drive mechanism 521, 531, 541 and the rider assembly controller 570. For example, the system controller 560 may access memory or receive as input a pre-defined motion profile 562 for the rider assembly 550, and this profile 562 may define the desired angle of the rider (or orientation of front edge or some other reference point/feature of the assembly 550) relative to a fixed reference frame in the system 500). The system controller 560 may instruct 569 the rider assembly controller 570 to operate the rotation mechanism 558 based on this pre-defined motion profile 562 to maintain vehicle/rider alignment toward one or more focal points (e.g., by maintaining a desired angle of the rider relative to the fixed reference frame).

During operations of the ride system 500, though, the turntables 520, 530, 540 are rotating about their rotation axes at one or more rotation rates and/or rotation directions. To maintain the desired angle for the rider assembly 550 (or its passengers), the system 500 is configured to collect angle measurements (amount of angular rotation) of each of the turntables 520, 530, 540 with sensors as shown at 565, 566, 567 and also for the rider assembly 550 as shown at 568. These measurements are gathered in real time such as multiple times per second or the like. The system controller 560 executes or uses a module 564 (e.g., a program or executable code) to process the angle measurements 565-568 to calculate the present rider angle relative to the fixed reference frame, which is passed to the system controller 560. The system controller 560 then may use a module (e.g., a program or executable code) 561 to perform error calculations (e.g., is the desired angle for the vehicle being maintained with the current rotation rate/direction for the rotation mechanism 558).

If correction is required based on the error calculation by module 561, a feedback or correction signal 569 is provided to the rider assembly controller 570 to modify operation of the rider assembly rotation mechanism 558. Real time angular measurements allow real time measurement of the present real world orientation (angular positioning) of each rider assembly 550 in the system 500 and, if not at a desired angle set by profile 562, the system 500 may operate to adjust operations of the rotation mechanism(s) 558 on-the-fly (during a ride program) to better align the rider assembly 550 with a show element or focal point within a show facility (e.g., face riders toward an area or portion of a projection screen).

The system 500 includes memory or data storage 570 storing one or more ride programs 572 for the ride system 500. For example, these ride programs may be used to achieve desired ride paths as shown in FIGS. 3A-3D for each rider assembly 550, and the ride programs 572 may also provide the pre-defined motion profile 562. The ride programs 572 are each shown to include or set the rotation rates and directions 574 for each of the nested/stacked turntables 520, 530, 540, and these operational parameters are provided in control signals 575 by the system controller 560 to the drive mechanisms 521, 531, 541.

Further, the system 500 is shown to include a media controller 580 that stores or receives (over a network) media content and/or show element control programs (e.g., control programs for animatronics, special effect devices, and other show elements). The system controller 560 may run a ride program 572 which may include triggers or other synchronization information that the system controller 560 may pass to the media controller 580 to synchronize operation of the media controller 580 with the other ride components including the turntable drive mechanisms 521, 531, 541 and the rider assembly rotation mechanism 558.

During operation of the system 500, the media controller 580 may be triggered by the system controller 560 to begin a show associated with a ride program 572. The media controller 580 may respond by transmitting media or control signals 585 to the one or more projectors or show elements 586. The media 585 may include still or video images that may be projected or output as shown at 588 by projectors 586 onto the upper surfaces of the platforms/turntables 520, 530, 540, onto sidewalls surrounding or placed near the turntables 520, 530, 540, and/or on the ceiling or surfaces above the rider assemblies 550.

The displayed imagery 588 may enhance the ride experience by providing a sense of lateral movement or horizontal translational movement for the passengers/riders of the rider assemblies 550. For example, the desired angle defined by the motion profile 562 may cause the riders/passengers of assembly 550 to face a "front" or other portion of a 360-degree theater screen provided about the periphery of the rotating turntable 520. The displayed imagery 588 may show rapidly approaching objects or objects moving in the opposite direction (such as canyon walls, trees, animals, other flying or driving vehicles, and the like).

The displayed imagery 588 may also include projections onto surfaces of the 360-degree theater or sidewalls to the left and/or right of the line of sight of the rider assembly 550 such that objects appear to move past the rider assembly at a rate that further provides the riders/passengers with the sense of movement, e.g., the rider assembly may include a pod/vehicle that can "fly" and the imagery 588 may include objects in the sky or at higher elevations (e.g., portions of a canyon wall, tree branches, clouds, birds, other flying objects, and so on). In other cases, the media/control information 585 is used to operate show elements 586 to create a display 588 that may be observed by the passengers of the rider assembly 550. For example, the rider assemblies 550 may be racing/chasing an animatronic character in its own rider assembly (show elements 586), and the control signals/information 585 may synchronize operation of the show elements 586 with the ride program 572 and/or motion profile 562 of the rider assembly 550.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

Prior to the described turntable race system, rides that appeared superficially similar to the race system included mechanical linkages between rotating elements. As a result, in these prior rides, all of the rotating elements have a single, fixed relationship. Alternatively, there was no linkage but the rotation was not controlled by a ride control system such that the rotating element (e.g., a tea cup) was free rotating or spinning Further, these prior rides did not attempt to combine controlled rotation of nested turntables and supported vehicles and translational movement of vehicles in a show space with media-driven story content.

We claim:

1. A ride apparatus, comprising:

a first turntable assembly including a first turntable and a drive mechanism operable to rotate the first turntable about a rotation axis extending vertically through the first turntable;

supported on the first turntable, a second turntable assembly including a second turntable and a drive mechanism operable to rotate the secondary turntable about a rotation axis extending vertically through the second turntable; and a number of passenger vehicles mounted on the second turntable, wherein the drive mechanism of the first turntable assembly and the drive mechanism of the second turntable assembly are operable to independently rotate the first and second turntables about the rotation axes; and further comprising a third turntable assembly including a third turntable, supported on the first turntable and supporting the second turntable, and a drive mechanism operable to rotate the third turntable about a rotation axis extending vertically through the third turntable.

2. The ride apparatus of claim 1, wherein the first turntable is rotated at a first rotation rate and the second turntable is rotated at a second rotation rate greater than the first rotation rate.

3. The ride apparatus of claim 1, wherein the first turntable is rotated in a first rotation direction about the rotation axis of the first turntable and the second turntable is rotated in a second direction about the rotation axis of the second turntable, the first and second rotation directions being the same or differing during operation of the ride apparatus.

4. The ride apparatus of claim 1, wherein the drive mechanism of the third turntable assembly is independently operable relative to the drive mechanisms of the first and second turntable assemblies to rotate the third turntable at a rotation rate and in a rotation direction, the rotation rate being greater than a rotation rate of the first turntable and the rotation direction being clockwise or counterclockwise.

5. The ride apparatus of claim 1, further including a rotation mechanism for each of the passenger vehicles operable during operation of the ride apparatus to rotate the passenger vehicles independently of the rotation of the second turntable.

6. The ride apparatus of claim 5, wherein the rotation mechanisms are each operated, concurrently with the rotation of the first and second turntables, to maintain an angular position of the passenger vehicle relative to a predefined focal point.

7. The ride apparatus of claim 6, further including mechanisms for monitoring angular positions of the first and second turntables and the passenger vehicles, for determining a present angular position of each of the passenger vehicles, and to operate the rotation mechanisms based on a comparison of the determined present angular positions with the angular position relative to the predefined focal point.

8. The ride apparatus of claim 1, further comprising a display surface extending along at least a portion of the periphery of the first turntable, wherein media content is provided on the display surface and wherein the provided media content is synchronized with the rotation of the first and second turntables and a line of sight of passengers in the passenger vehicles.

9. A turntable system, comprising:

a primary turntable rotating, during operation of the ride, at a first rate and in a first direction about a primary rotation axis;

supported on the primary turntable, a number of secondary turntables each rotating independently of the primary turntable, during operation of the ride, at a second rate and in a second direction about one of a number of secondary rotation axes;

supported on each of the secondary turntables, a number of tertiary turntables each rotating independently of the primary and secondary turntables, during operation of the ride, at a third rate and in a third rotation direction about one of a number of tertiary rotation axes; and supported on each of the tertiary turntables, one or more passenger vehicles.

10. The turntable system of claim 9, further comprising a display screen extending about at least a portion of the periphery of the primary turntable and a media controller delivering media content to the display screen, the delivered media content including a center of attention portion displayed on an area of the display screen and the passenger vehicles being oriented during operation of the turntable system to provide passenger of the passenger vehicles with a line of sight to the area of the display screen.

11. The turntable system of claim 10, further including a rotation mechanism for each of the passenger vehicles operable during the rotation of the turntables to rotate the passenger vehicles to maintain the line of sight to the area of the display screen.

12. The turntable system of claim 9, wherein the first rate is less than the second rate and wherein the second rate is less than the third rate.

13. The turntable system of claim 9, wherein at least one of first, second, and third rotation directions is clockwise and at least one of the first, second, and third rotation directions is counterclockwise.

14. The turntable system of claim 9, wherein the rotating of the primary, secondary, and tertiary turntables is provided by individually controlled motors attached to each of the primary, secondary, and tertiary turntables.

15. The turntable system of claim 9, wherein upper surfaces of the primary, secondary, and tertiary turntables are substantially coplanar.

16. A turntable race system, comprising:

a primary turntable assembly including a primary turntable and a drive mechanism operable to rotate the primary turntable about a central rotation axis extending vertically through the primary turntable;

supported on the primary turntable, a plurality of secondary turntable assemblies each including a secondary turntable and a drive mechanism operable to rotate the secondary turntable about a rotation axis extending through the secondary turntable and radially offset from the central rotation axis of the primary turntable;

supported on each of the secondary turntable assemblies, a plurality of tertiary turntable assemblies each including a tertiary turntable and a drive mechanism to rotate the tertiary turntable about a rotation axis extending through the tertiary turntable;

a plurality of rider assemblies supported on each of the tertiary turntables, each of the rider assemblies including a rider pod and rotation mechanism rotating the rider pod about a rotation axis extending through the rider pod; and a display assembly positioned adjacent the primary turntable and including a display screen operable to display a video image.

17. The turntable race system of claim 16, wherein the rotation mechanisms are operated independently to rotate each of the rider pods to an angular orientation providing a rider of the rider pod with a line of sight to the display screen.

18. The turntable race system of claim 17, wherein the video image is adapted to provide the rider with a sensation of movement of the rider pod toward the display screen.

19. The turntable race system of claim 16, wherein the drive mechanisms are each independently operable to define rotation rates and rotation directions for the primary turntable and each of the secondary and tertiary turntables and wherein at least some of the rotation rates differ.

20. A ride apparatus, comprising:

a first turntable assembly including a first turntable and a drive mechanism operable to rotate the first turntable about a rotation axis extending vertically through the first turntable;

supported on the first turntable, a second turntable assembly including a second turntable and a drive mechanism operable to rotate the secondary turntable about a rotation axis extending vertically through the second turntable;

a number of passenger vehicles mounted on the second turntable, wherein the drive mechanism of the first turntable assembly and the drive mechanism of the second turntable assembly are operable to independently rotate the first and second turntables about the rotation axes; and a rotation mechanism for each of the passenger vehicles operable during operation of the ride apparatus to rotate the passenger vehicles independently of the rotation of the second turntable, wherein the rotation mechanisms are each operated, concurrently with the rotation of the first and second turntables, to maintain an angular position of the passenger vehicle relative to a predefined focal point.

21. The ride apparatus of claim 20, wherein the first turntable is rotated at a first rotation rate and the second turntable is rotated at a second rotation rate greater than the first rotation rate.

22. The ride apparatus of claim 20, wherein the first turntable is rotated in a first rotation direction about the rotation axis of the first turntable and the second turntable is rotated in a second direction about the rotation axis of the second turntable, the first and second rotation directions being the same or differing during operation of the ride apparatus.

23. The ride apparatus of claim 20, further including a third turntable assembly including a third turntable, supported on the first turntable and supporting the second turntable, and a drive mechanism operable to rotate the third turntable about a rotation axis extending vertically through the third turntable and wherein the drive mechanism of the third turntable assembly is independently operable relative to the drive mechanisms of the first and second turntable assemblies to rotate the third turntable at a rotation rate and in a rotation direction, the rotation rate being greater than a rotation rate of the first turntable and the rotation direction being clockwise or counterclockwise.

24. The ride apparatus of claim 20, further including mechanisms for monitoring angular positions of the first and second turntables and the passenger vehicles, for determining a present angular position of each of the passenger vehicles, and to operate the rotation mechanisms based on a comparison of the determined present angular positions with the angular position relative to the predefined focal point.

25. The ride apparatus of claim 20, further comprising a display surface extending along at least a portion of the periphery of the first turntable, wherein media content is provided on the display surface and wherein the provided media content is synchronized with the rotation of the first and second turntables and a line of sight of passengers in the passenger vehicles.

26. A ride apparatus, comprising:

a first turntable assembly including a first turntable and a drive mechanism operable to rotate the first turntable about a rotation axis extending vertically through the first turntable;

supported on the first turntable, a second turntable assembly including a second turntable and a drive mechanism operable to rotate the secondary turntable about a rotation axis extending vertically through the second turntable;

a number of passenger vehicles mounted on the second turntable, wherein the drive mechanism of the first turntable assembly and the drive mechanism of the second turntable assembly are operable to independently rotate the first and second turntables about the rotation axes; and a display surface extending along at least a portion of the periphery of the first turntable, wherein media content is provided on the display surface and wherein the provided media content is synchronized with the rotation of the first and second turntables and a line of sight of passengers in the passenger vehicles.

27. The ride apparatus of claim 26, wherein the first turntable is rotated at a first rotation rate and the second turntable is rotated at a second rotation rate greater than the first rotation rate.

28. The ride apparatus of claim 26, wherein the first turntable is rotated in a first rotation direction about the rotation axis of the first turntable and the second turntable is rotated in a second direction about the rotation axis of the second turntable, the first and second rotation directions being the same or differing during operation of the ride apparatus.

29. The ride apparatus of claim 26, further including a third turntable assembly including a third turntable, supported on the first turntable and supporting the second turntable, and a drive mechanism operable to rotate the third turntable about a rotation axis extending vertically through the third turntable and wherein the drive mechanism of the third turntable assembly is independently operable relative to the drive mechanisms of the first and second turntable assemblies to rotate the third turntable at a rotation rate and in a rotation direction, the rotation rate being greater than a rotation rate of the first turntable and the rotation direction being clockwise or counterclockwise.

30. The ride apparatus of claim 26, further including a rotation mechanism for each of the passenger vehicles operable during operation of the ride apparatus to rotate the passenger vehicles independently of the rotation of the second turntable.

31. The ride apparatus of claim 30, wherein the rotation mechanisms are each operated, concurrently with the rotation of the first and second turntables, to maintain an angular position of the passenger vehicle relative to a predefined focal point and further including mechanisms for monitoring angular positions of the first and second turntables and the passenger vehicles, for determining a present angular position of each of the passenger vehicles, and to operate the rotation mechanisms based on a comparison of the determined present angular positions with the angular position relative to the predefined focal point.

* * * * *